US007128586B2

(12) United States Patent
Kung

(10) Patent No.: US 7,128,586 B2
(45) Date of Patent: Oct. 31, 2006

(54) LOCKING MECHANISM FOR SECURING COMMUNICATION PORT ON ELECTRONIC APPARATUS

(76) Inventor: Ching-Hu Kung, 956 Burrows Cres, NW Edmonton AB (CA) T6R 2L2

( * ) Notice: Subject to any disclaimer, the term of this patent is extended or adjusted under 35 U.S.C. 154(b) by 0 days.

(21) Appl. No.: 11/202,175

(22) Filed: Aug. 12, 2005

(65) Prior Publication Data

US 2006/0211291 A1 Sep. 21, 2006

(30) Foreign Application Priority Data

Mar. 18, 2005 (TW) ..... 94108453 A

(51) Int. Cl.
*H01R 13/44* (2006.01)

(52) U.S. Cl. ..... 439/133

(58) Field of Classification Search ..... 439/133, 439/135, 149

See application file for complete search history.

(56) References Cited

U.S. PATENT DOCUMENTS 5,220,815 A 6/1993 Davidge et al.
6,788,216 B1 * 9/2004 Chen ..... 340/693.5
6,796,152 B1 9/2004 Yu
2003/0224637 A1 * 12/2003 Ling ..... 439/133
2004/0074264 A1 * 4/2004 Kung et al. ..... 70/58
2005/0028571 A1 * 2/2005 Merrem et al. ..... 70/58
2005/0039502 A1 * 2/2005 Avganim ..... 70/58
2005/0202698 A1 * 9/2005 Miao ..... 439/133

* cited by examiner

*Primary Examiner*—Gary F. Paumen
(74) *Attorney, Agent, or Firm*—Birch, Stewart, Kolasch & Birch, LLP

(57) ABSTRACT

A locking mechanism for securing communication port on electronic apparatus includes a lock carrier; a control element mounted on the lock carrier; more than one controlled arm movably connected to the control element; and a lock piece detachably connected to front ends of the controlled arms. The lock piece alone is inserted into a port on an electronic apparatus through operating the control element to release the controlled arms from the lock piece while allowing a rear end of the lock piece to flush with or locate a small distance inside an open end of the port.

16 Claims, 6 Drawing Sheets

LOCKING MECHANISM FOR SECURING COMMUNICATION PORT ON ELECTRONIC APPARATUS

FIELD OF THE INVENTION

The present invention relates to a locking mechanism, and more particularly to a locking mechanism for securing communication port on electronic apparatus.

BACKGROUND OF THE INVENTION

Currently, there are many storing devices using a communication port on an electronic apparatus, such as a universal serial bus (USB), as a transmission interface. Such communication ports are constantly improved to have upgraded functions and capacity. However, valuable data stored in the storing devices are also frequently stolen via the conveniently available communication ports on the electronic apparatus.

It is therefore tried by the inventor to develop a locking mechanism for securing communication port on electronic apparatus.

SUMMARY OF THE INVENTION

A primary object of the present invention is to provide a locking mechanism for locking a port on an electronic apparatus.

Another object of the present invention is to provide a locking mechanism for preventing stealing of data from a storing device via a communication port on an electronic apparatus.

A further object of the present invention is to provide a locking mechanism including a lock piece that could be separately fitted in a communication port of an electronic apparatus.

A still further object of the present invention is to provide a locking mechanism that includes controlled arms with protrusions and notches to achieve the locking function.

To achieve the above and other objects, the locking mechanism for securing communication port on electronic apparatus according to the present invention includes a lock carrier 11; a control element 111 mounted on the lock carrier 11; more than one controlled arm 112 movably connected to the control element 111; and a lock piece 114 detachably connected to front ends of the controlled arms 112. The lock piece 114 alone is inserted into a communication port 115 on an electronic apparatus through operating the control element 111 to release the controlled arms 112 from the lock piece 114 while allowing a rear end of the lock piece 114 to flush with or locate a small distance inside an open end 115*a* of the communication port 115.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
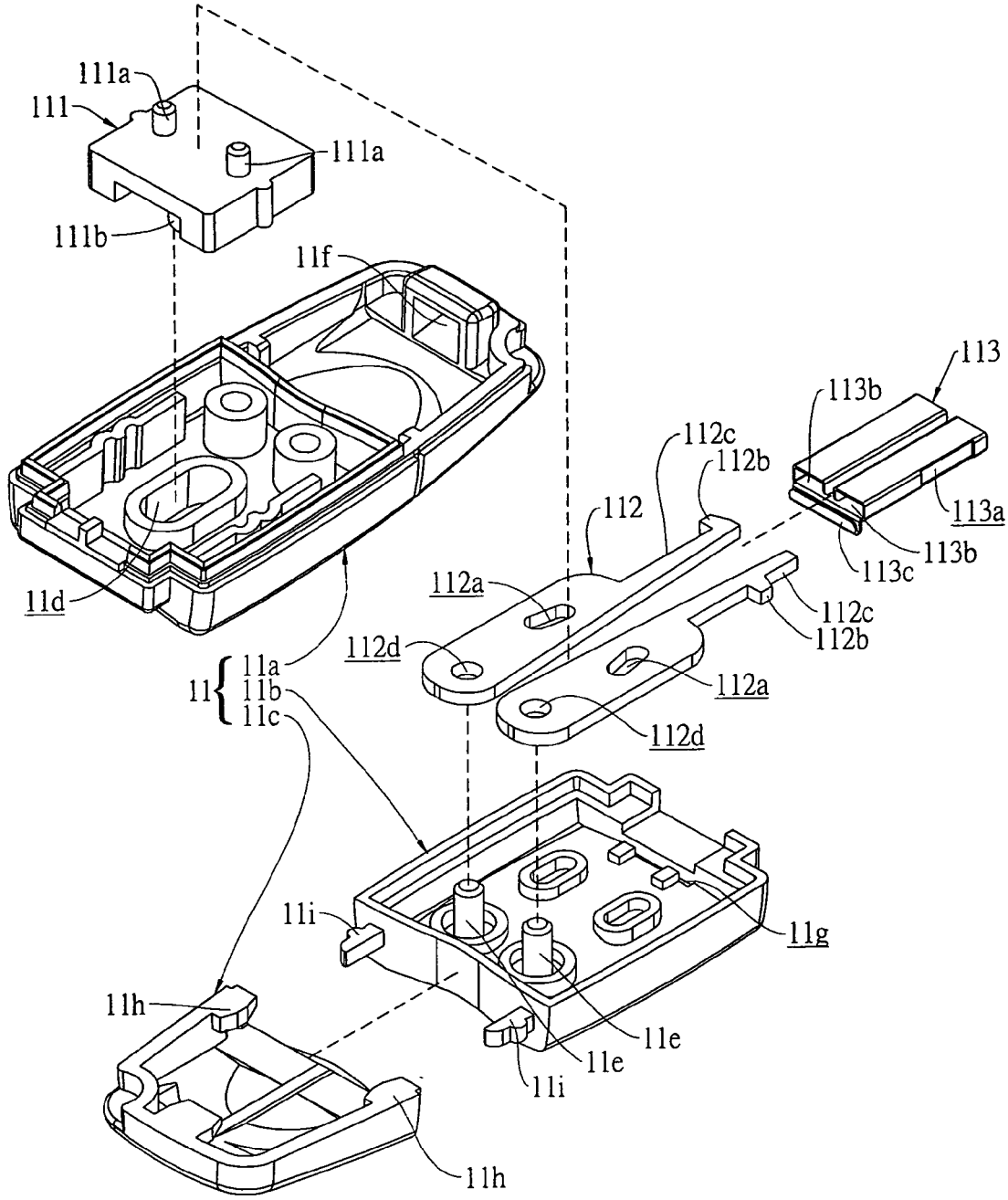
FIG. 1 is an exploded perspective view of a locking mechanism according to a preferred embodiment of the present invention.
Figure 2:
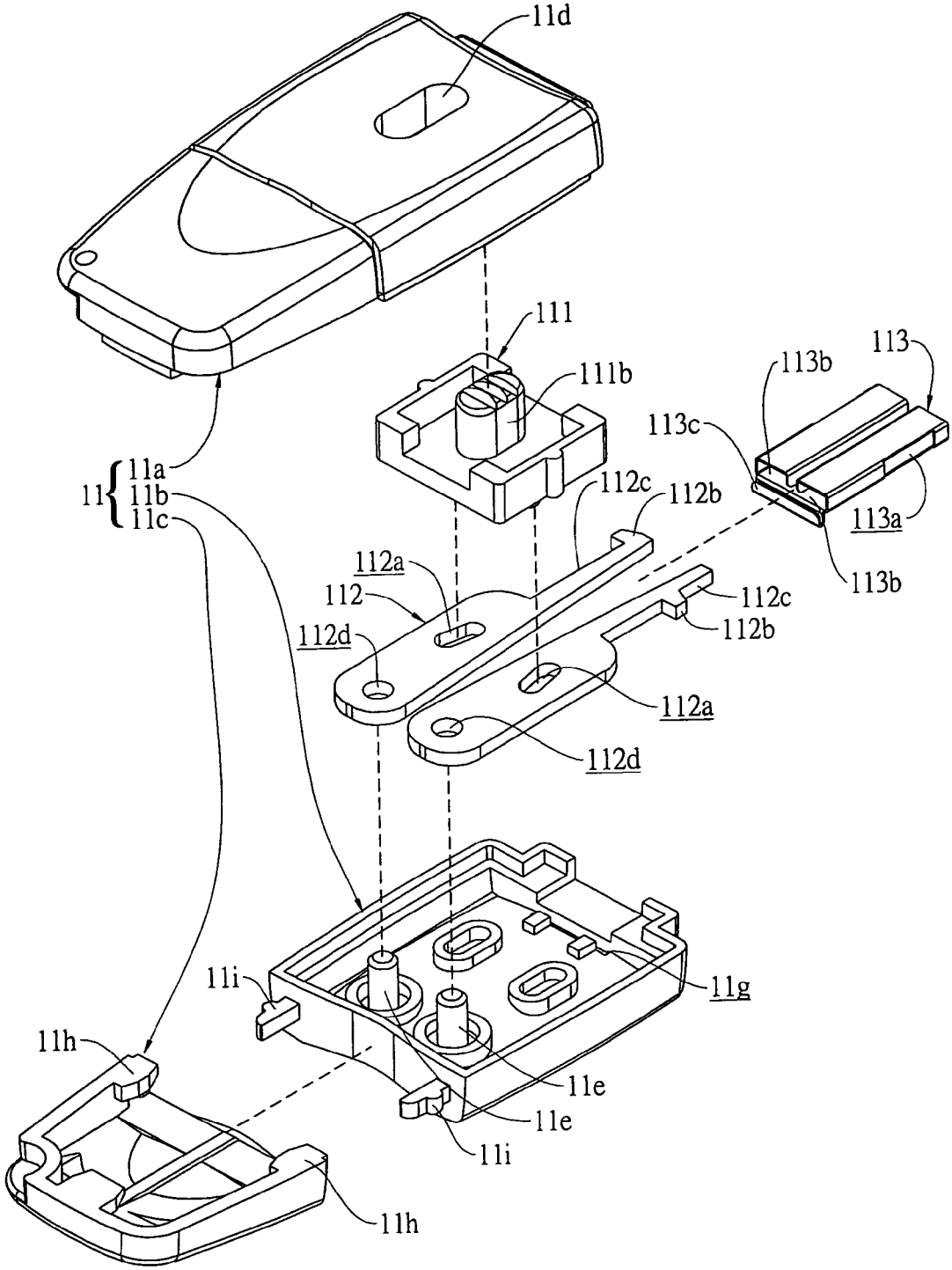
FIG. 2 is another exploded perspective view of the locking mechanism of FIG. 1.
Figure 6:
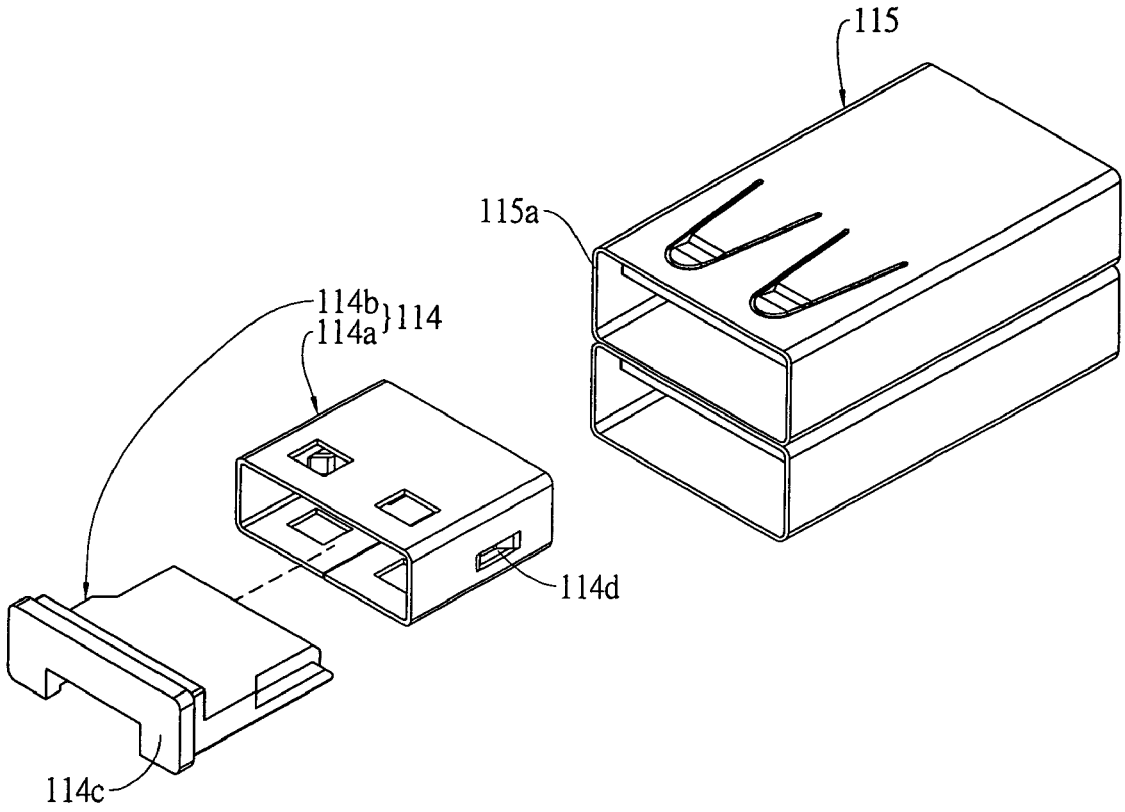
FIG. 6 is an exploded perspective view showing the relation between a lock piece of the locking mechanism of the present invention and a port on an electronic apparatus.
Figure 7:
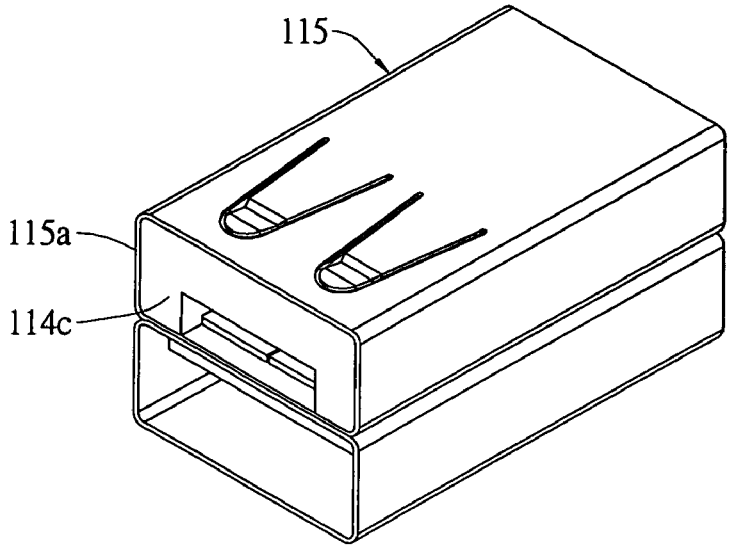
FIG. 7 is an assembled perspective view of FIG. 6.

Please refer to FIGS. 1 and 2 that are two exploded perspective views of a locking mechanism for securing communication port on electronic apparatus according to a preferred embodiment of the present invention. As shown, the locking mechanism mainly includes a lock carrier 11, on which a control element 111 is provided to associate with two controlled arms 112. The control element 111 is provided at a lower side with two downward projected rods 111*a* corresponding to and engaged with two slide slots 112*a* separately formed on the two controlled arms 112, so that the controlled arms 112 are held to the lock carrier 11. Each of the controlled arms 112 includes one or more protrusions 112*b* and accordingly one or more notches 112*c*. An intermediate connector 113 is assembled to the two controlled arms 112 for detachably holding a lock piece 114 to a front end of the lock carrier 11 (see FIG. 3). The intermediate connector 113 is provided at two opposite sides with two first engaging openings 113*a*, and the lock piece 114 is provided at two opposite sides with two second engaging openings 114*d*, such that the protrusions 112*b* on the two controlled arms 112 may extend into the first engaging openings 113*a* and the second engaging openings 114*d* to firmly hold the lock piece 114 to the intermediate connector 113. The lock carrier 11 includes an upper case 11*a*, a lower case 11*b*, and a cover 11*c*. When the lock piece 114 is not in use, it may be temporarily received in the cover 11*c*. As can be seen from FIGS. 3 and 6, the lock piece 114 includes an insert body 114*a* and a faceplate 114*b*.

Figure 3:
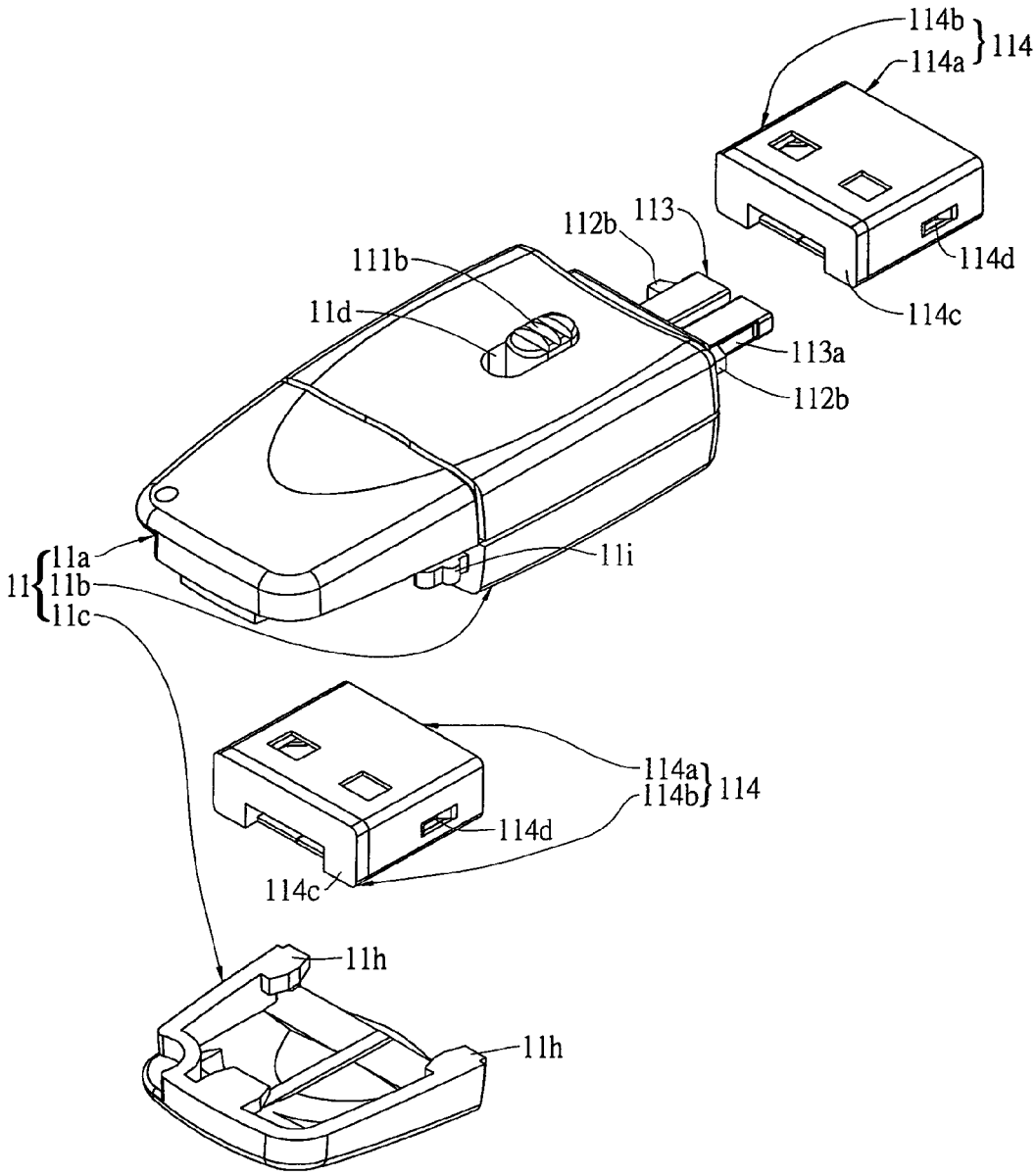
FIG. 3 is a partially exploded perspective view of the locking mechanism of FIG. 1.
Figure 4:
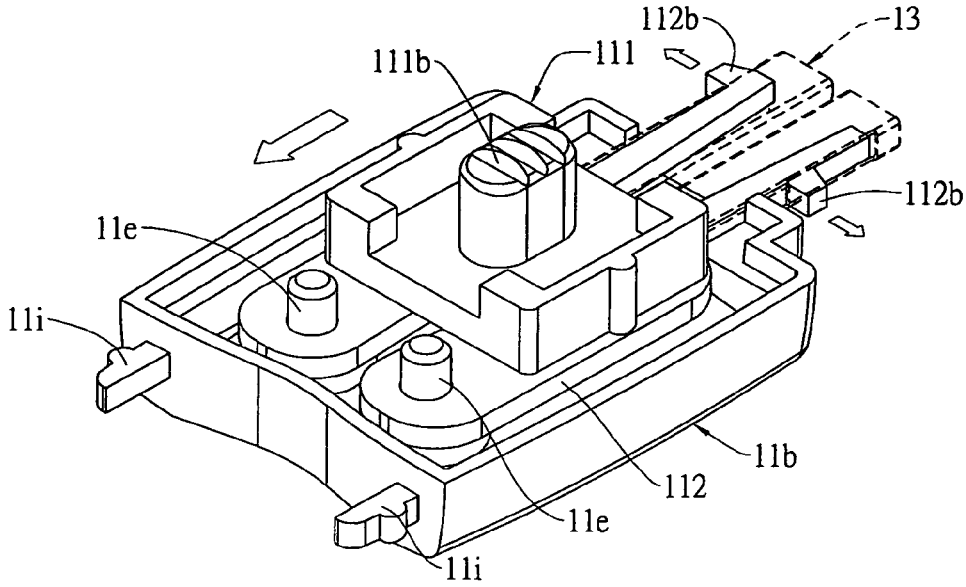
FIGS. 4 and 5 are perspective views showing the operation of a control element on the locking mechanism of the present invention.
Figure 5:
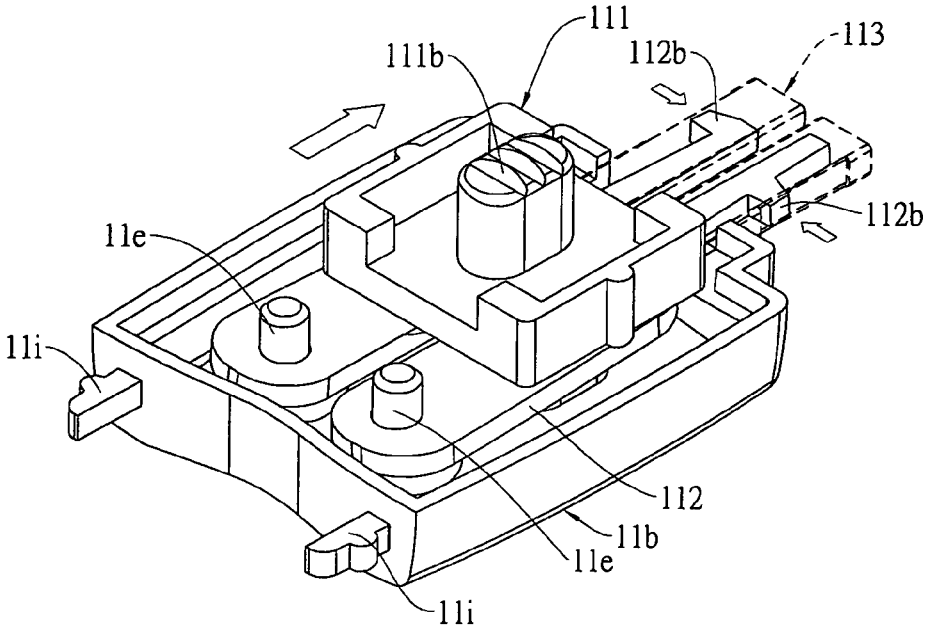

Please refer to FIGS. 1 and 3 at the same time. To assemble the lock mechanism of the present invention, first cause a switch key 111*b* provided on an upper side of the control element 111 to locate in a through hole 11*d* provided on the upper case 11*a*, and the two downward rods 111*a* to extend through the two slide slots 112*a* on the two controlled arms 112; and then pivotally connect two holes 112*d* separately provided on the two controlled arms 112 to two bars 11*e* upward projected from the lower case 11*b*, such that front ends of the controlled arms 112 forward project from a front opening 11*f* on the upper case 11*a* to extend into a receiving space 113*b* of the intermediate connector 113, with the protrusions 112*b* on the controlled arms 112 engaged with the first engaging openings 113*a* on the intermediate connector 113. In this position, a hooking portion 113*c* of the intermediate connector 113 is adapted to engage with a recess 11*g* formed on the lower case 11*b*. Finally, the cover 11*c* is connected to the lower case 11*b* by engaging female connectors 11*h* on the cover 11*c* with male connectors 11*i* on the lower case 11*b*.

Please now refer to FIGS. 4, 5, 6 and 7 at the same time. When it is desired to lock a communication port 115 on an electronic apparatus using the lock piece 114, first push the switch key 111*b* of the control element 111 forward, so that the two rods 111*a* below the control element 111 engaged with the two slide slots 112*a* of the controlled arms 112 move along the slide slots 112*a* to bring the front ends of the two controlled arms 112 to shift inward toward each other. Then, extend the inward shifted controlled arms 112 into the lock piece 114. Thereafter, push the switch key 111*b* of the control element 111 backward, and the two rods 111*a* below the control element 111 move along the slide slots 112*a* to bring the two controlled arms 112 to shift outward and space from each other. At this point, the lock piece 114 is held to the controlled arms 112. Then, insert the lock piece 114 into the communication port 115 of the electronic apparatus with a rear end 114*c* of the lock piece 114 flushing with an open end 115*a* of the communication port 115. At this point, push the control element 111 forward again to bring the two controlled arms 112 to shift toward each other and release from the lock piece 114.

Figure 8:
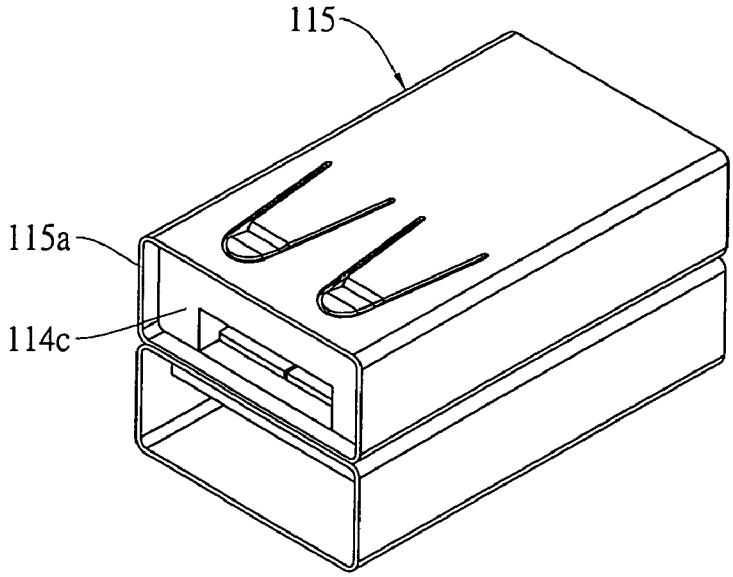
FIG. 8 is a perspective view showing the assembling of a lock piece to a port on an electronic apparatus according to another embodiment of the present invention.

FIG. 8 shows another embodiment of the present invention. This embodiment is generally structurally similar to the above-described preferred embodiment, except that the rear end 114*c* of the lock piece 114 is located a small distance inside the open end 115*a* of the communication port 115 when the lock piece 114 is fully inserted into the communication port 115.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A locking mechanism for securing communication port on electronic apparatus, comprising a lock carrier; a control element mounted on said lock carrier; more than one controlled arm movably connected to said control element; and a lock piece detachably connected to front ends of said controlled arms; said lock piece alone being inserted into a communication port on an electronic apparatus through operating said control element to release said controlled arms from said lock piece while allowing a rear end of said lock piece to be flush with an open end of said communication port.

2. The locking mechanism for securing communication port on electronic apparatus as claimed in claim 1, wherein said lock carrier includes an upper case, a lower case, and a cover.

3. The locking mechanism for securing communication port on electronic apparatus as claimed in claim 2, wherein said lock piece is temporarily received in said cover when said lock piece is not in use.

4. The locking mechanism for securing communication port on electronic apparatus as claimed in claim 1, wherein each of said controlled arms is provided with at least one protrusion.

5. The locking mechanism for securing communication port on electronic apparatus as claimed in claim 4, further comprising an intermediate connector connected to the front ends of said controlled arms.

6. The locking mechanism for securing communication port on electronic apparatus as claimed in claim 1, wherein each of said controlled arms is provided with at least one notch.

7. The locking mechanism for securing communication port on electronic apparatus as claimed in claim 6, further comprising an intermediate connector connected to the front ends of said controlled arms.

8. The locking mechanism for securing communication port on electronic apparatus as claimed in claim 1, wherein said lock piece includes an insert body and a faceplate.

9. A locking mechanism for securing communication port on electronic apparatus, comprising a lock carrier; a control element mounted on said lock carrier; more than one controlled arm movably connected to said control element; and a lock piece detachably connected to front ends of said controlled arms; said lock piece alone being inserted into a communication port on an electronic apparatus through operating said control element to release said controlled arms from said lock piece while allowing a rear end of said lock piece to be located a small distance inside an open end of said port.

10. The locking mechanism for securing communication port on electronic apparatus as claimed in claim 9, wherein said lock carrier includes an upper case, a lower case, and a cover.

11. The locking mechanism for securing communication port on electronic apparatus as claimed in claim 10, wherein said lock piece is temporarily received in said cover when said lock piece is not in use.

12. The locking mechanism for securing communication port on electronic apparatus as claimed in claim 9, wherein each of said controlled arms is provided with at least one protrusion.

13. The locking mechanism for securing communication port on electronic apparatus as claimed in claim 12, further comprising an intermediate connector connected to the front ends of said controlled arms.

14. The locking mechanism for securing communication port on electronic apparatus as claimed in claim 9, wherein each of said controlled arms is provided with at least one notch.

15. The locking mechanism for securing communication port on electronic apparatus as claimed in claim 14, further comprising an intermediate connector connected to the front ends of said controlled arms.

16. The locking mechanism for securing communication port on electronic apparatus as claimed in claim 9, wherein said lock piece includes an insert body and a faceplate.

* * * * *